United States Patent [19]

Lea

[11] Patent Number: 4,852,311

[45] Date of Patent: Aug. 1, 1989

[54] ROOF STRUCTURES

[76] Inventor: Sandra Lea, Cross Cottage, Holt-on-Dee, Nr. Wrexham, Clwyd, LL13 9JA, Wales

[21] Appl. No.: 172,073

[22] Filed: Mar. 23, 1988

[30] Foreign Application Priority Data

Mar. 26, 1987 [GB] United Kingdom ..... 8707232
Jan. 18, 1988 [GB] United Kingdom ..... 8801028

[51] Int. Cl.[4] ..... E04B 7/02
[52] U.S. Cl. ..... 52/92; 52/95; 52/199
[58] Field of Search ..... 52/90, 199, 407, 22, 52/92, 93, 95

[56] References Cited

U.S. PATENT DOCUMENTS

| | | | |
|---|---|---|---|
| 2,318,820 | 5/1943 | Voigt | 52/407 |
| 2,397,345 | 3/1946 | Gilleland | 52/407 |
| 3,001,613 | 9/1961 | McBerty | 52/407 |
| 3,086,323 | 4/1963 | Pine | 52/199 |
| 3,385,013 | 5/1968 | Severson | 52/90 |
| 4,307,548 | 12/1981 | Nelson | 52/90 |

FOREIGN PATENT DOCUMENTS

| | | |
|---|---|---|
| 1501778 | 11/1967 | France . |
| 2101327 | 3/1972 | France . |
| 2590295 | 5/1987 | France . |
| 6802609 | 8/1969 | Netherlands . |
| 7614608 | 7/1978 | Netherlands . |
| 246600 | 1/1947 | Switzerland . |

*Primary Examiner*—Henry E. Raduazo
*Attorney, Agent, or Firm*—Anthony J. Casella; Gerald E. Hespos

[57] ABSTRACT

A stressed skin panel comprising a pair of elongate planar plywood sheets which are spaced apart, with a uniform distance therebetween, by means of longitudinally extending, internal joists. Attached to the inner surface of one sheet is a body of heat insulation material, the thickness of which is such that a continuous ventilation passage is defined between the heat insulation material and the inner surface of the other plywood sheet. Both of the two plywood sheets are cut back at both ends to expose the internal joists, the extent of cut-back being less in the case of the second sheet than the first sheet so that the second sheet overhangs the first sheet at both ends of the panel. In use, the exposed end portions of the joists receive fixing means, such as bolts, for mounting the panel in an operational position.

3 Claims, 2 Drawing Sheets

ROOF STRUCTURES

DESCRIPTION

The present invention is concerned with roof structures for buildings.

The traditional method of constructing roofing structures has involved the erection of a plurality of deep section parallel wooden rafters which are subsequently covered with external cladding materials, as necessary. To reduce the size of section these rafters can be supported by use of purlins at 90° which cut down effective span. However, purlins in themselves become too large a section over spans beyond 5 m or so. An alternative arrangement is to use wooden trusses which, with currently used systems, inevitably extend across the loft space defined between the roof covering and the top floor ceiling. The useable loft space is thereby totally restricted and it is difficult and costly to modify the structure in order to create sufficient loft space to be useable as an additional room(s). Attempts have therefore been made in recent years to devise new means of forming roof structures which do not involve the necessity for purlins or trussed rafters so as to leave the loft space clear. One solution, now used fairly widely in continental Europe (particularly in Holland), is based on so-called stressed skin plywood panels. Such panels comprise a pair of planar sheets of plywood which are held apart by internal joists with a uniform spacing therebetween of about 140 mm. In these known panels, the space between the two parallel sheets is filled completely with a heat insulation material, such as a foam or glass-fibre based material.

Such panels have not been found acceptable elsewhere since it is believed that the lack of ventilation within the panels can lead to interstitial condensation and their subsequent deterioration in a relatively short time. Roofing structures using such panels have therefore failed to pass the local Building Regulations in other countries and therefore cannot be used. Erection of such panels in Holland involves use of cranes on site and very sophisticated connection details that can prove too complex to manage in some situations because of differences in local site labour and organisation.

The principal objects of the present invention are to provide solutions to the latter two problems so as to enable insulated stressed skin panels, particularly but not exclusively stressed skin plywood type panels, to be used with the confidence that panels are ventilated to reduce risk of rot and provide a simple on-site fixing system without use of site plant and complicated connection techniques that are alien to the indigenous labour force.

In accordance with the present invention in its broadest aspect, there is provided a stressed skin panel comprising a pair of elongate planar sheets which are spaced apart, with a uniform distance therebetween, by means of longitudinally extending, internal joists, there being mounted to the inner surface of one of said sheets a body of heat insulation material, the thickness of which is such that a continuous ventilation passage is defined between the heat insulation material and the inner surface of the other of said sheets.

Normally, the planar sheets would be of plywood. However, other primarily wood-based materials could also be used such as fibre-board, chip-board, waferboard and other particle boards.

In accordance with a preferred embodiment of the present invention, there is provided a stressed skin plywood panel comprising a pair of elongate planar plywood sheets which are spaced apart, with a uniform distance therebetween, by means of longitudinally extending, internal joists, there being attached to the inner surface of one of said sheets a body of heat insulation material, the thickness of which is such that a continuous ventilation passage is defined between the heat insulation material and the inner surface of the other of said plywood sheets.

Such panels, when provided with exposed joist ends, allow traditional fixing techniques for panels on site.

Preferably, one surface of said one plywood sheet carries a vapour barrier for reducing the passage of water vapour therethrough.

In use, the longitudinal ends of the two plywood sheets can be cut back (usually to different extents) in order to expose end portions of the joists whereby these exposed end portions can be used to receive fixing means, such as bolts, nails etc., to enable the panel to be mounted in its operational position. For example, such exposed joist ends may be connected directly to existing beams, wallplates, ridges or cantilevered floor beams projecting over the external wall beyond normal wallplate line, or to exposed joists of other panels, depending upon the practical situation and the configuration of the structure required. Connection details at exposed ends are thus simple and traditional in format and thus easily understood by site labour force. In one preferred form of the panel in accordance with the invention, both of the two plywood sheets are cut back at both ends to expose the internal joists, but the extent of cutback is greater in the case of one sheet than the other so that the one sheet overhangs the other sheet at both ends of the panel. Preferably, the extent of such overhang is different at the two ends of the panel. The ends of the exposed joists can be mitred as appropriate to suit the angle at which the panel is to be connected to an adjacent structure.

The invention is described further hereinafter, by way of example only, with reference to the accompanying drawings, in which.

Figure 3A:
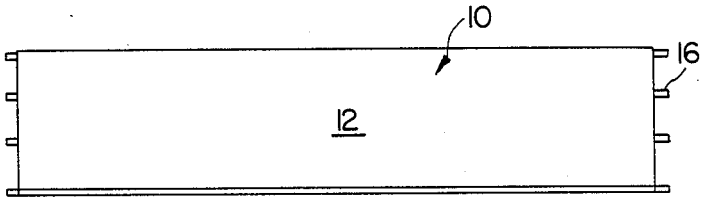
Figure 3B:
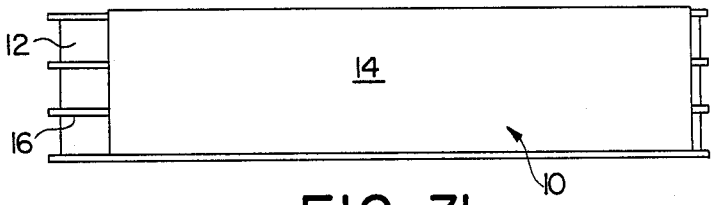
Figure 4:
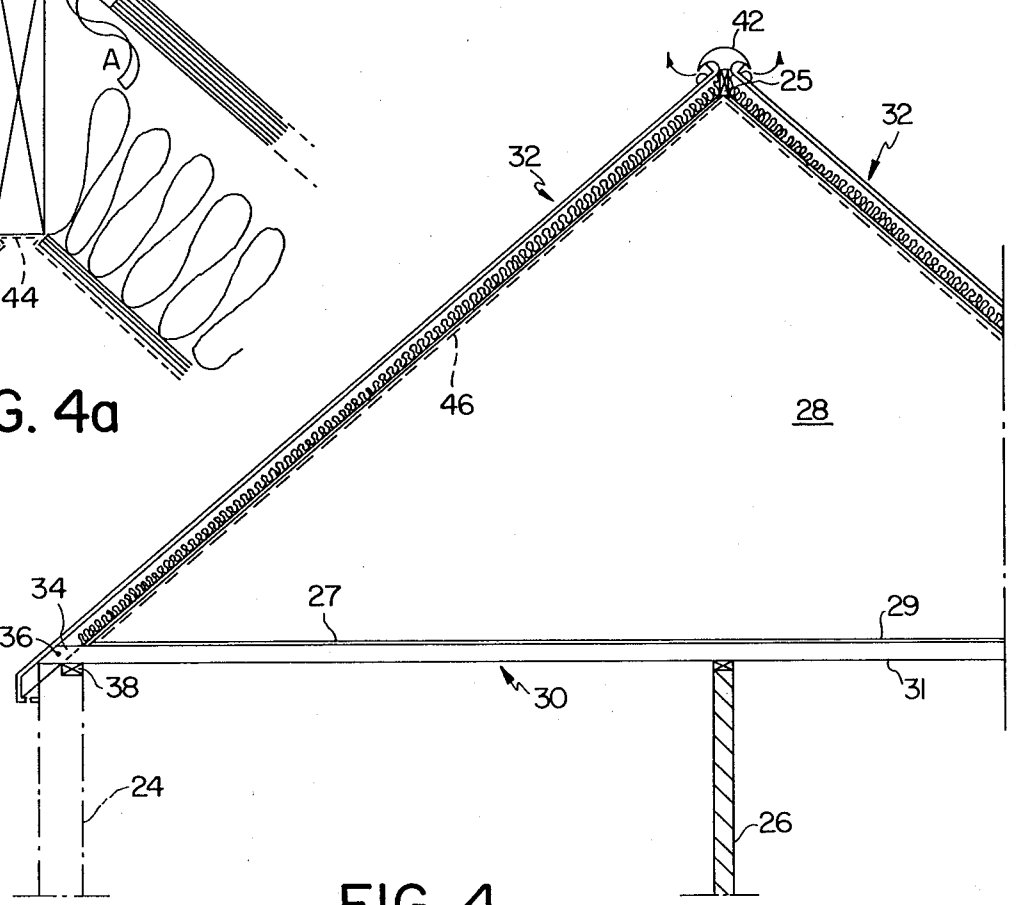
Figure 4A:
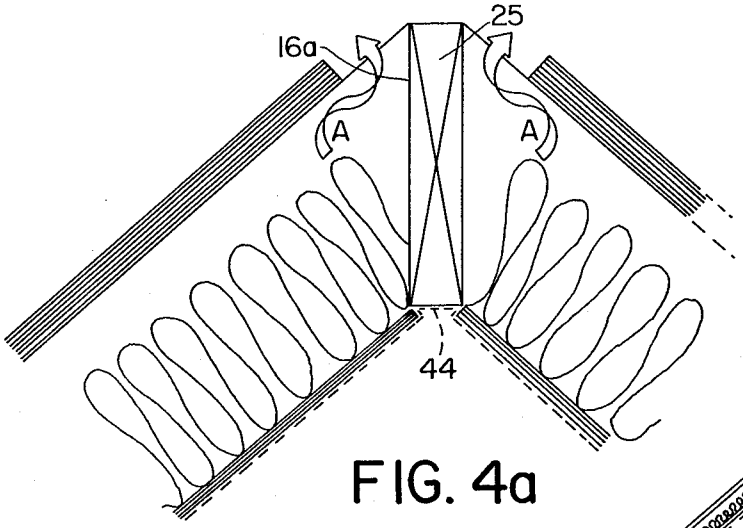
Figure 5:
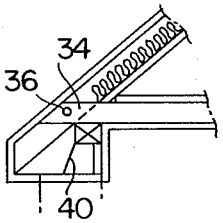

FIG. 3*a* and 3*b* are top and bottom views respectively of a panel in accordance with the present invention;

FIG. 4 is a transverse section through part of a roof structure constructed using panels in accordance with the present invention;

FIG. 4*a* shows a detail of the structure of FIG. 4, to a larger scale; and FIG. 5 shows one way in which the lower edges of the panels in the structure of FIG. 4 can be supported.

Figure 1:
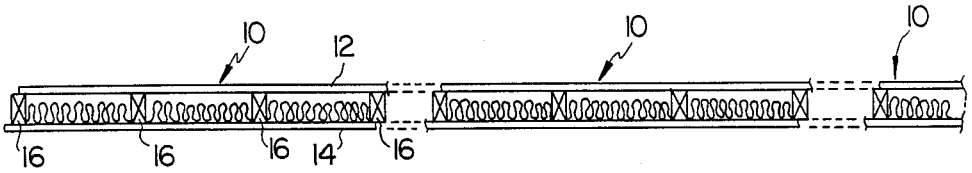
FIG. 1 is an end view of a number of building panels in accordance with the present invention.
Figure 2:
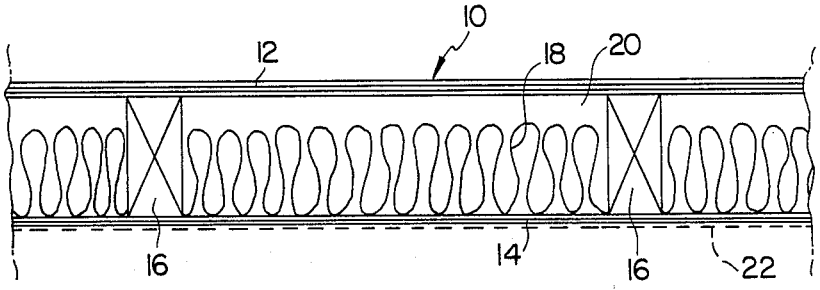
FIG. 2 is an end view of part of one of the panels of FIG. 1, to a larger scale.

Referring first to FIGS. 1 and 2, the illustrated panels 10 in accordance with the present invention each comprise a pair of planar rectangular plywood sheets 12,14 which are held apart, with a uniform gap of about 140 mm therebetween, by means of four longitudinally extending wooden joists 16. In the illustrated embodiment, the two outer joists 16 define the longitudinal side walls of the panel, the other two joists 16 being disposed at equal distances intermediate the outer joists. As best seen in FIG. 1, the upper and lower sheets 12,14 are laterally displaced slightly in opposite directions in order to provide stepped side edges to the panels for assisting overlapping mating engagement between two adjacent panels when they are placed side-by-side and brought into mutual abutment.

As best seen in FIG. 2, there is attached to the inner surface of the lower sheet 14 a layer 18 of insulation material, such as that sold under the Trademark STYROFOAM (thermal conductivity 0.025 W/mk). It should be noted that the particular type of insulation chosen will be determined to suit Building Regulations Requirements and that the thermal conductivity selected will depend upon the degree of insulation required. The attachment of the insulation material can be achieved.by means of a suitable adhesive. Alternatively, insulation can be spray applied to the lower sheet 14 depending on type. It will be noted that the thickness of the insulation 18 is considerably less than the distance between the sheets 12,14. In the illustrated embodiment where the latter distance is about 140 mm, the preferred thickness of the insulation 18 is about 100 mm or less. There thus remains a clear space 20 having a minimum depth of about 40 mm between the top of the insulation 18 and the inner surface of the upper sheet 12. This clear space 20 is provided in order to for a ventilation passage over the insulation and along the whole length of the panel, as described further hereinafter.

Again referring principally to FIG.2, the external surface of the lower sheet 14 of the panel can be, covered by a layer 22 of a material which forms a vapour barrier to reduce water vapour from entering the interior of the panel through the lower sheet 14. Alternatively or in addition, the vapour barrier may be applied to the interior of the panel on to the inward facing surface of the lower sheet of ply 14 and up the sides of the wooden joists 16 to the level of the upper surface of the insulation 18 after the joists 16 have been fixed to the lower plywood panel 14.

In the illustrated embodiment, it is preferred for the upper sheet 12 to be about twice the thickness of the lower sheet 14. Suitable thicknesses have been found to be 12.5 mm for the upper sheet 12 and 7.5 mm for the lower sheet 14, although these could vary. The preferred overall size of the panels 10 is approximately 6 meters by 1.2 meters, although of course, other sizes could equally well be selected.

Turning now to FIGS. 4 and 4*a* there is shown, by way of example only, one manner of application of the present panels to a typical roofing situation for a domestic house, i.e. to a pitched roof having a single ridge and two gable ends. The house to which the roof is to be applied is assumed to have brickwork 24 defining an outer wall of the house (only one side shown) and further brickwork 26 defining an internal load-bearing wall. This central load bearing wall may not be necessary if stronger floor beams are used. (It should be understood, however, that the house could equally well be of timber-frame construction). Supported between the outer walls 24 and inner wall 26 to form a floor structure 30 are a first plurality of panels 27 formed in this example by upper and lower plywood sheets 29,31 held about 100 mm apart by joists, (not shown). Preferably, the upper and lower sheets 29,31 have thicknesses of the order of 15.5 mm and 7.5 mm, respectively. The lower sheet 31 has a plasterboard and skim finish fire protection. Unlike the panels 10, the panels 27 contain no heat insulating material in their interior space, which remains empty apart from the joists. The apices of the two gable-end walls 28 (brick) or timber frame of the house define slots between which is supported an (optional) wooden ridge beam 25 (see FIG. 4*a*). A plurality of panels 10 are then supported between the ridge beam 25 and the outer walls 24 to form the pitched roof structure 32.

FIGS. 3*a* and 3*b* show top and bottom plan views of panels 10 modified to be suitable to form the sloping roof structure 32. As shown in FIG. 3*b*, the lower plywood sheet 14 is cut-away considerably at the left-hand end of the panel (which is to be the lower end in the assembled roof structure 32). The upper plywood sheet 12 at this end of the panel is also cut-away somewhat but to a lesser extent, dependent upon pitch. Thus, the joists 16 project fully to this end of the panel, but the lower and upper sheets 12,14 are cut-away to a greater and lesser extent respectively. At the opposite, right-hand end of the panel (which is to be the upper end in the assembled roof structure 32) the lower sheet 14 is again cut back further than the upper sheet 12 but the extent of the difference is considerably less than at the left-hand end of the panel.

Where stressed skin panels are used in the floor structure, the upper and lower sheets 29,31 at the ends of the horizontal panels 27 forming the floor are cut back so as to leave projecting joist portions 34 which lie on top of the external wall 24. As shown in FIG. 4, the exposed joists 16 at the lower ends of the sloping panels 10 are attached to the projecting joist portions 34, for example by bolts and/or nails 36 in order to secure the lower ends of the panels 10 in position. The exposed joist portions 16*a* at the upper ends of the sloping panels 10 abut the ridge beam 28 and are rigidly secured thereto, for example by bolts or nails (not shown).

In the illustrated embodiment, the roof panels can themselves be secured to further wooden beams 38 positioned along the top of the walls 24 and possibly (see FIG. 5) supported themselves by horizontal steel lintels 40. Equally, horizontal panels 27 could be fixed at a distance below the intersection of sloping panels 10 with the external wall by rigidly securing exposed joist portions of sloping panel 10 to deep section wooden beams 38 positioned along the top of walls 24 with horizontal panels 27 secured to wooden beams 38 independently at a lower level in the external wall. Thus horizontal panels 27 and sloping panels 10 can be used separately or together in the construction.

It will be noted that atmospheric air can enter the lower ends of the panels 10 via their open undersides and then pass along the lengths of the panels through the spaces 20 above the insulation 18 (there are three such spaces 20 in this instance, defined between the four joists 16) before exiting once again to atmosphere via the cut-back portions in the upper sheets 12 (see arrows A in FIG. 4*a*), thus promoting an air flow through the panels and discouraging internal condensation.

In order to prevent rainwater gaining entry to the upper ends of the panels, the apex of the roof is preferably protected by means of a conventional ventilated ridge tile system wherein arcuate ridge tiles 42 are supported above the apex of the roof so as to leave a passage for the air flow to escape from the panels but to prevent the entry of rainfall thereto. Any other suitable system can, however, be used for preventing rainwater entry. As shown in FIG. 4*a*, the lower surface of the ridge beam may also be provided with a vapour barrier 44.

The undersides of the sloping panels 10 may also be provided with fire-resistant paint 46 or finish over the vapour barrier 22.

As shown in FIG. 4, the upper plywood sheet 12 of the panels 10 extends downwardly to the rafter ends to carry the roof finish to the gutter line. It should be noted that the lower section of this plywood sheet may be added after erection (i.e. from wall plane to gutter line).

It is not intended that the invention be limited to the examples shown in the drawings. Thus, for example, it will be appreciated that the lengths of the cut-back portions of the sheets 12,14 of the panel will be dependent, inter alia, on the slope of the roof, the extent of soffit overhang required and indeed on the overall intended configuration of the roof. The invention is not limited to double-pitched roofs but could be applied, for example, to roofs for extensions where a single sloping roof is to be used whose upper end abuts against a vertical wall surface. In the latter case, the joint with the wall would have to be protected by a modified form of tile which would allow air flow to/from the panels but prevent the ingress of rainwater.

Although FIG. 4 shows the use of a stressed panel floor structure 30, this construction is not essential and in other embodiments the floor structure can comprise conventional joists spanning between external (or other load-bearing) walls and having conventional plywood or chipboard floor panels on top and a plasterboard ceiling beneath. In the latter case, however, provision must again be made for floor joists to extend out over the tops of the external walls to meet and connect with rafters in the roof panels (as in FIG. 5) to anchor the feet of the "A" frame formed by the roof panels 32. Already known patented floor beams may also be adapted to connect with rafters in panels.

Although the specified thicknesses of the wooden sheets 12,14 is preferred, the invention is not restricted to these dimensions.

In the event that stiffeners (noggins) are provided in the panels, at 90° relative to the joists, these should be perforated (50/50 proportions solid/gap), at least in the regions corresponding to the clear space 20 above the insulation 18, i.e. the top 40 mm in the illustrated example. Trimmers to rooflights should be perforated and ends of rafters joining trimmers should ensure air flow around rooflight.

By ensuring that the interiors of the panels are ventilated in the above-described manner, the previous potential problems of internal condensation are avoided. By exposing the ends of joists as described, simple on-site fixing of panels is achieved by use of traditional fixing methods, treating exposed ends as if standard rafter construction to traditional detail which is familiar to on-site labour. Greater spans can be achieved with small section timbers without restricting loft space and final configuration presents an already lined ceiling space ready for occupation within the capabilities of a typical labour force.

I claim:

1. A stressed skin panel comprising:

(a) first and second elongate planar plywood sheets for defining lower and upper skins, respectively, of the panel in use;

(b) longitudinally extending, internal wooden joists nailed and glued between said first and second elongate planar plywood sheets so as to mount said plywood sheets in parallel, spaced-apart relationship, with a uniform distance therebetween;

(c) a body of heat insulation material mounted to portions of the first plywood sheet intermediate the joists;

(d) the thickness of said body of heat insulation material being such that a continuous ventilation passage is defined between said body of heat insulation material and the second one of said plywood sheets;

(e) at its one end, the panel being mitred for joining to a similarly mitred end of another of said panels to form a ridge of a roof; and (f) at the other end of the panel, the corresponding ends of both of the first and second plywood sheets being cut back in relation to adjacent ends of said joists so that the joists project freely beyond both of said first and second sheets, the extent of the cut back of the second sheet for defining the upper skin being less than that of the first sheet for defining the lower skin.

2. A pitched roof structure for mounting above a building structure having horizontal wooden ceiling joists and vertical wall plates, said pitched roof structure comprising a plurality of stressed skin panels each of which comprises:

(a) first and second elongate planar plywood sheets for defining lower and upper skins, respectively, of the panel in use;

(b) longitudinally extending, internal wooden joists nailed and glued between said first and second elongate planar sheets so as to mount said sheets in parallel, spaced-apart relationship, with a uniform distance therebetween; and (c) a body of heat insulation material mounted to portions of the first sheet intermediate the joists, the thickness of said body of heat insulation material being such that a continuous ventilation passage is defined between said body of heat insulation material and the second plywood sheet;

(d) at its one end, each panel being mitred for joining to a similarly mitred end of another of said panels to form a ridge of said roof structure;

(e) at the other end of each panel, the corresponding ends of both of the first and second plywood sheets being cut back in relation to adjacent ends of said joists so that the joists project freely beyond both of said first and second sheets, the extent of the cut back of the second sheet for defining the upper skin being less than that of the first sheet for defining the lower skin;

said panels being mounted above said building structure in a pitched configuration, with said second planar plywood sheet uppermost, so as to define an open space between the panels and said building structure and with said ventilation spaces within the panels extending obliquely upwardly towards an upper end of the roof; and said projecting joist ends being connected rigidly to respective members selected from the horizontal wooden ceiling joists and wall plates of the building structure.

3. A pitched rood structure as in claim 2 wherein the second plywood sheet for defining the upper skin extends substantially into contact with the horizontal wooden ceiling joists of said building structure.

* * * * *